US010321780B1

(12) United States Patent
James

(10) Patent No.: US 10,321,780 B1
(45) Date of Patent: Jun. 18, 2019

(54) PARCEL SECURITY APPARATUS

(71) Applicant: Raymond James, Jacksonville, FL (US)

(72) Inventor: Raymond James, Jacksonville, FL (US)

( * ) Notice: Subject to any disclaimer, the term of this patent is extended or adjusted under 35 U.S.C. 154(b) by 0 days.

(21) Appl. No.: 15/586,398

(22) Filed: May 4, 2017

(51) Int. Cl.
*A47G 29/12* (2006.01)
*A47G 29/16* (2006.01)

(52) U.S. Cl.
CPC ..... *A47G 29/1209* (2013.01); *A47G 29/16* (2013.01)

(58) Field of Classification Search
CPC ..... A47G 29/1209; A47G 29/1214; A47G 29/1223; A47G 29/14; A47G 29/16; A47G 2029/1257; A47G 2029/144; A47G 2029/148; A47G 2029/149; A47G 29/20; B65D 11/186
USPC ..... 232/22, 17, 19, 45, 30–32, 34–36, 43.2, 232/29, 38; 220/4.29, 6
See application file for complete search history.

(56) References Cited

U.S. PATENT DOCUMENTS 471,918 A * 3/1892 Van Pelt ..... A47G 29/12 232/28
961,897 A * 6/1910 Rosenberg et al. .... A47G 29/12 232/28
1,001,080 A * 8/1911 Rosenberg et al. .... A47G 29/12 232/28
1,673,769 A * 6/1928 Graham ..... G07C 13/02 220/6
1,838,801 A * 12/1931 Anderson ..... A47G 29/1207 232/32
1,915,980 A * 6/1933 Craft ..... A47G 29/12 232/19
2,194,226 A * 3/1940 Holdren ..... A47G 29/12 232/17
2,421,221 A * 5/1947 Rothe ..... B07C 7/04 232/30
2,532,134 A * 11/1950 Wiedman ..... A47G 29/22 232/19
2,604,260 A * 7/1952 Brown ..... A47G 29/12 232/19
4,909,052 A 3/1990 Hutwohl
5,624,071 A 4/1997 Sosan
5,845,843 A * 12/1998 Kuller ..... A47G 29/12 232/38
6,155,715 A * 12/2000 Lake ..... A47G 29/20 150/102
6,426,699 B1 * 7/2002 Porter ..... A47F 10/00 221/2
9,364,112 B2 6/2016 Sundaresan
9,596,952 B2 * 3/2017 Mencel ..... A47G 29/20
(Continued)

*Primary Examiner* — William L Miller
(74) *Attorney, Agent, or Firm* — Lawrence J. Gibney; Mitchell Ghaneie

(57) ABSTRACT

The present invention is a device that assists with securing packages of varying sizes to the door or a home, apartment, or business. The device is capable of collapsing when not in use or while hanging on the user's door. Once a package is delivered and dropped into the secured apparatus, only the user will have access to the package by unlocking a pick-up door located on the device's bottom enclosure and retrieving the package from an interior bag. The user may additionally provide an enlarged bag to hang and secure to the outside of the device, if the package is expected to be too large to fit within the bottom enclosure of the apparatus.

16 Claims, 7 Drawing Sheets

(56) References Cited

U.S. PATENT DOCUMENTS

| | | | | |
|---|---|---|---|---|
| 9,926,108 | B2 * | 3/2018 | Wiley | B65D 33/00 |
| 2016/0051073 | A1 * | 2/2016 | Heinz | A47G 29/141<br>232/39 |

* cited by examiner

PARCEL SECURITY APPARATUS

BACKGROUND OF THE INVENTION

A. Field of the Invention

The present invention relates to securing a delivered package at the door of a residence or commercial building if that occupant is not present.

B. Prior Art

While there are many parcel security devices utilized today, none provide the unique and novel features provided by the present invention. Current parcel security devices are incapable of attaching to the exterior of a door, accommodating a variety of differently sized parcels, or both. A representative example of the prior art can be found in the following patents.

In U.S. Pat. No. 5,624,071 an apparatus for receiving packages is disclosed. While this invention hangs from the top of a door, it is not capable of accepting larger packages, such as shoe boxes or boxes containing electronics. The '071 patent also does not collapse or contain an interior bag.

In U.S. Pat. No. 4,909,052 a door safe for delivery and pickup of articles is disclosed. The door safe is hung from the top of the door and is capable of securing relatively small items.

In U.S. Pat. No. 9,364,112 a secure portable apparatus for accepting parcels and deliveries is disclosed. This invention is attached to the doorknob or door handle of a door and rests on the ground. Furthermore, this device does not collapse or provide an interior bag similarly to the two references above.

BRIEF SUMMARY OF THE INVENTION

The present invention is a parcel security apparatus that is capable of hanging from the top of a door, securing packages, and collapsing. Having packages delivered to one's home or business is becoming an increasingly more popular way to shop. However, the home or business owner is often not sure when her or his package is to be delivered or cannot be home when the package is delivered. Accordingly, package theft is a significant concern of home or business owners, which can be mitigated with the use of the present invention.

This invention will allow individuals to secure a package while she or he is away by providing a secure drop off door and a secure accessible enclosure, which is located directly beneath the drop off door. Once a package is submitted through the drop off door it falls into an interior bag within the bottom enclosure for pick up later. The bottom enclosure provides a lockable pick-up door and is collapsible.

Beneath the bottom enclosure is a plurality of hooks that can hold a larger bag for securing big packages such as televisions, speakers, computers, as well as small furniture boxes and other large products.

The device may also provide alarm and notification features that inform neighbors or the user's mobile communication device that a package has been delivered or that the device is being tampered with.

BRIEF DESCRIPTION OF THE DRAWINGS

FIG. 8 is a diagram of the device and the components that is comprised of.

NUMBERING REFERENCE

5—Device
6—Top enclosure
8—Bottom enclosure
10—Drop off door
11—Drop off door handle
12—Drop off door hinge
15—Hanger
20—Pick up door
21—Pick up door handle
22—Pick up door hinge
23—Lock
24—Pins
25—Hook
30—Interior bag
35—Track
40—Panel hinges
45—Brace
50—Exterior bag
55—Sensor
60—Camera
65—Transmitter
70—Controller

DETAILED DESCRIPTION OF THE EMBODIMENTS

Figure 6:
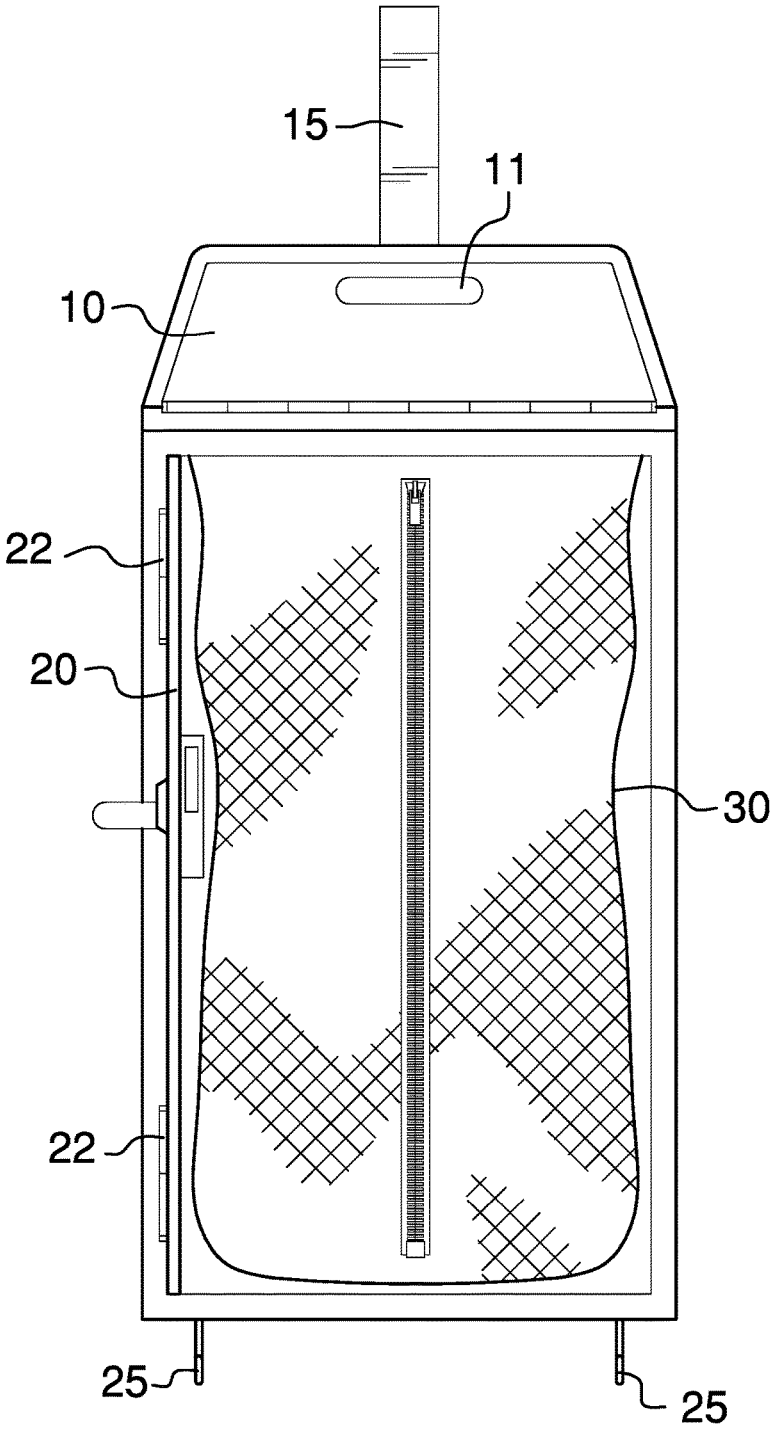
FIG. 6 is a front view of the device, which is showing the pickup door in an opened position and therefore showing the interior bag.
Figure 7:
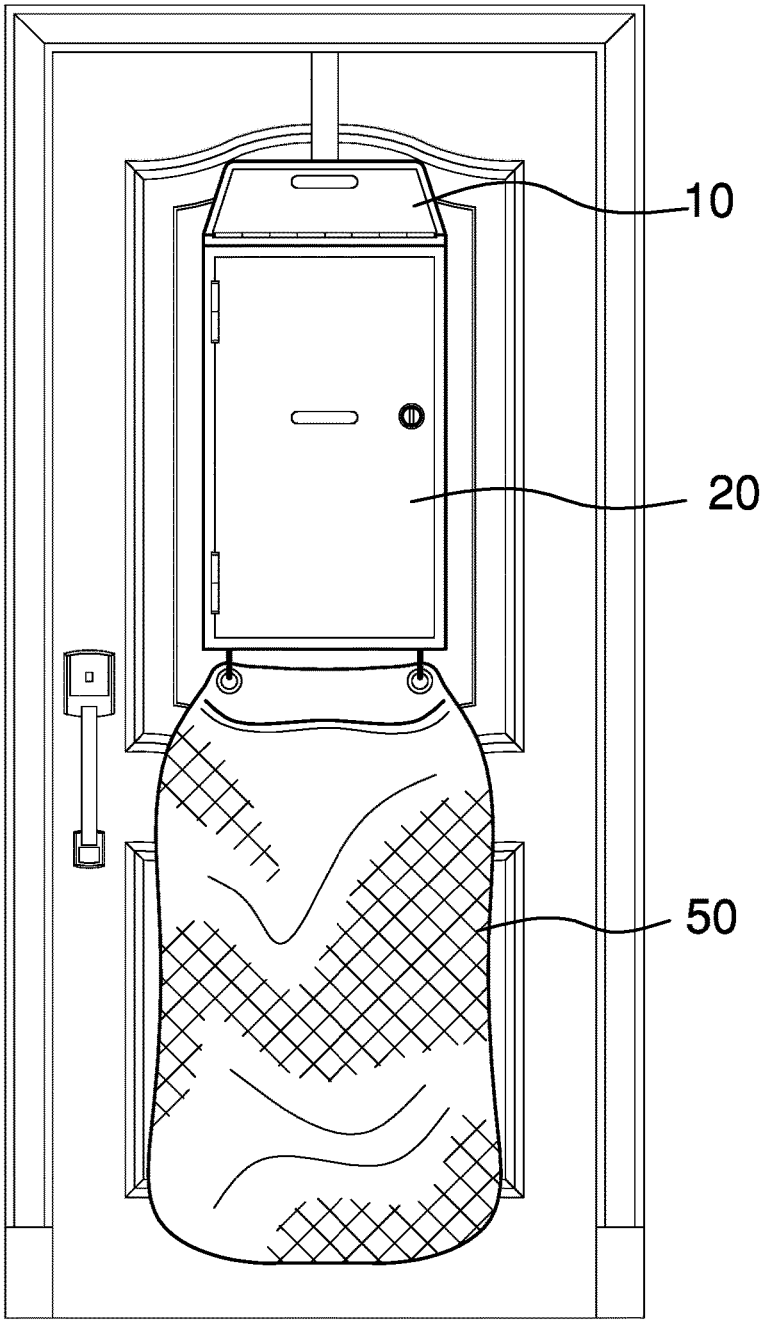
FIG. 7 is an in-use front view of the device which is holding an exterior bag from the bottom of the device.
Figure 8:
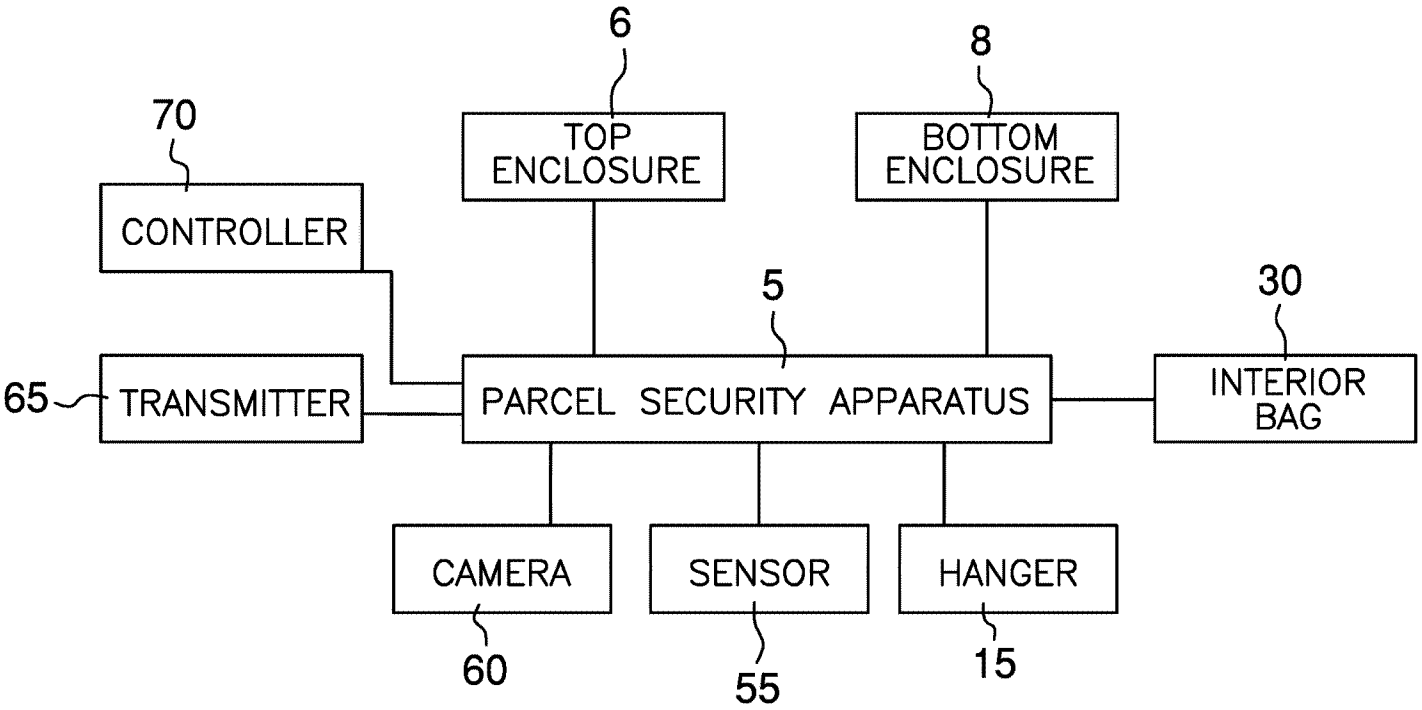

This invention is a collapsible parcel security apparatus which is comprised of a top enclosure 6, a bottom enclosure 8, a hanger 15, and an interior bag 30. The top enclosure 6 is comprised of a drop off door 10, drop off door handle 11, a drop off door hinge 12, and a track 35. The bottom enclosure 8 is further comprised of a pick-up door 20, at least one pick-up door handle 21, at least one pick-up door hinge 22, a lock 23, a plurality of pins 24, at least one hook 25, a plurality of hinges 40, and at least one brace 45. The interior bag 30 is flexible in nature and provides a zipper as depicted in FIG. 6. The hanger 15 is located at the top of the device.

Figure 4:
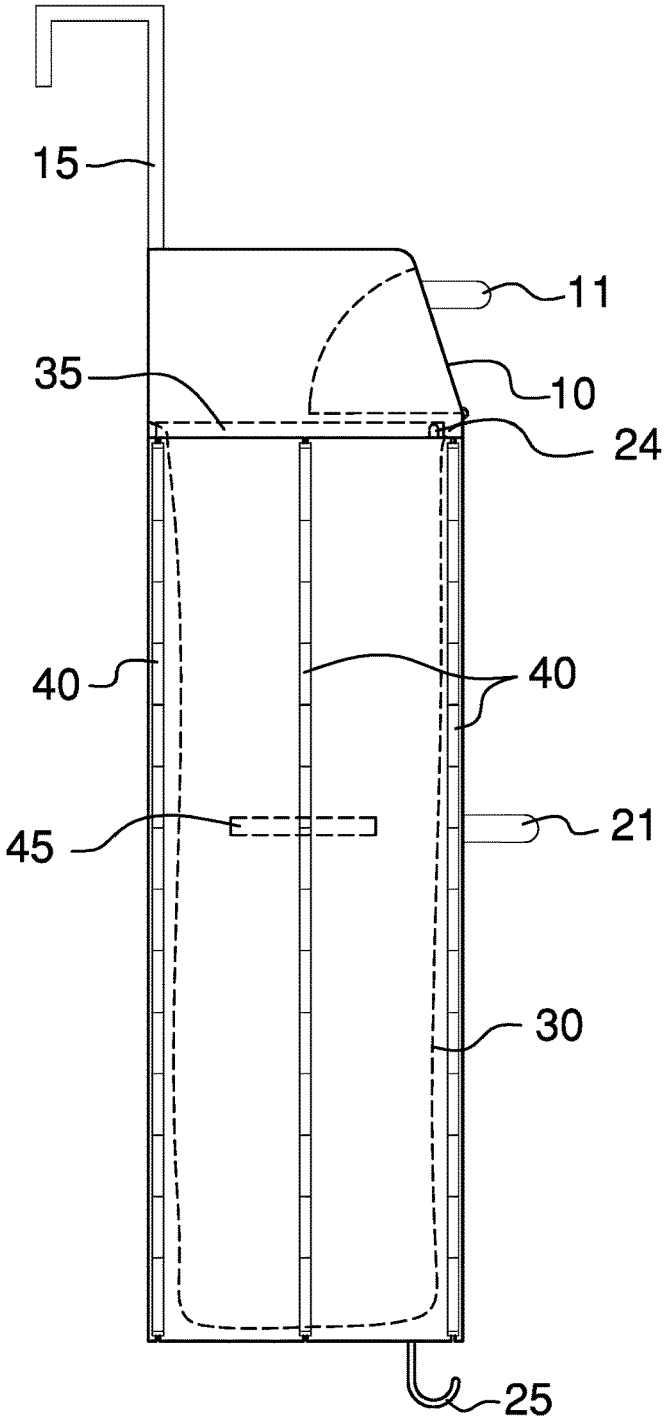
FIG. 4 is a side view of the device, which is depicting the drop off door, interior bag in dotted lines, interior locking brace in dotted lines, and track in dotted lines.
Figure 5:
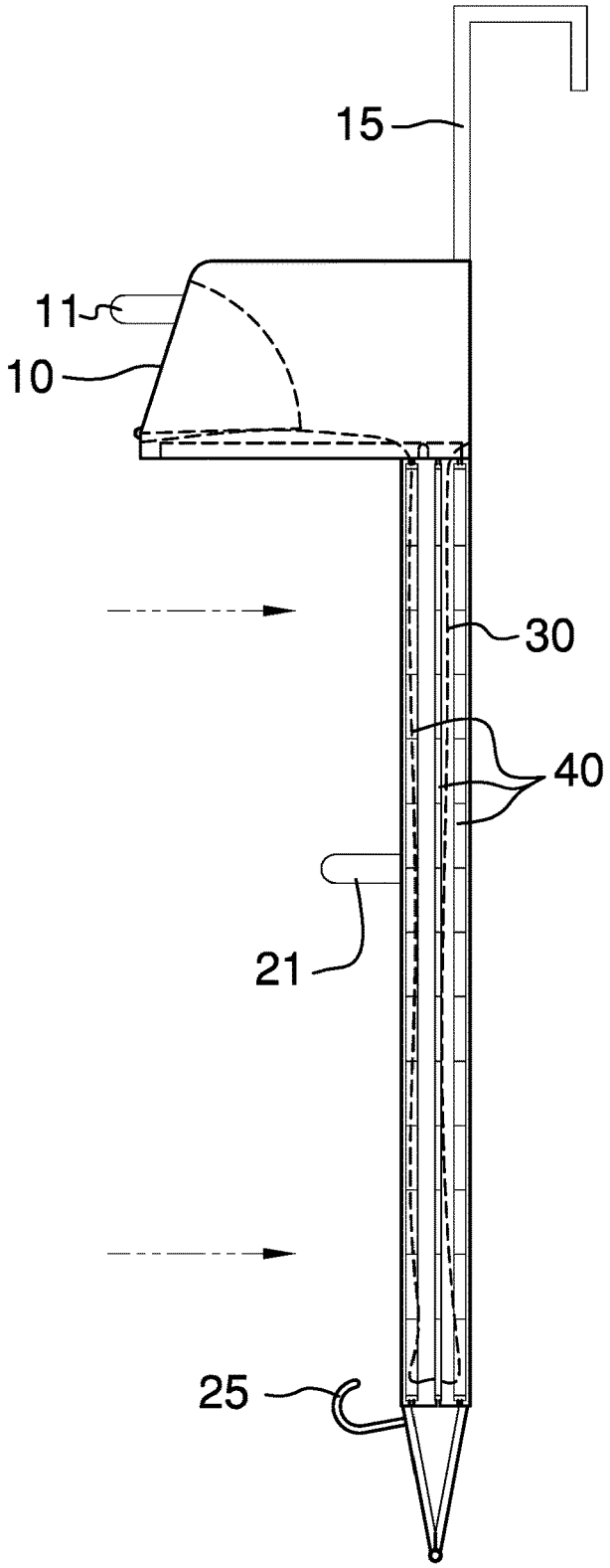
FIG. 5 is a side view of the device, which is showing the bottom enclosure in a collapsed position.

The drop off door 10 is a security door that prevents an individual from reaching inside the device. The drop off door 10 has a handle 11 and rotates along a hinge 12. A track 35 is provided at the bottom of the top enclosure 6, which is shown in FIG. 4. The interior bag 30 has an open end and a closed end. The open end of the interior bag is attached to the interior of the top enclosure 6 above the track 35 and the closed end hangs into the bottom enclosure 8, which is also shown in FIG. 4.

With attaching the interior bag 30 above the track 35, the apparatus may remain secured even when the bottom enclosure 8 is in a collapsed position. Accordingly, when the bottom enclosure 8 is collapsed the interior bag is exposed. Thus, it is anticipated that the bag can be knife resistant or cut resistant. It is further anticipated that a knife resistant shield may be provided over a portion of the bag that is left exposed when the bottom enclosure 8 is collapsed.

Figure 2:
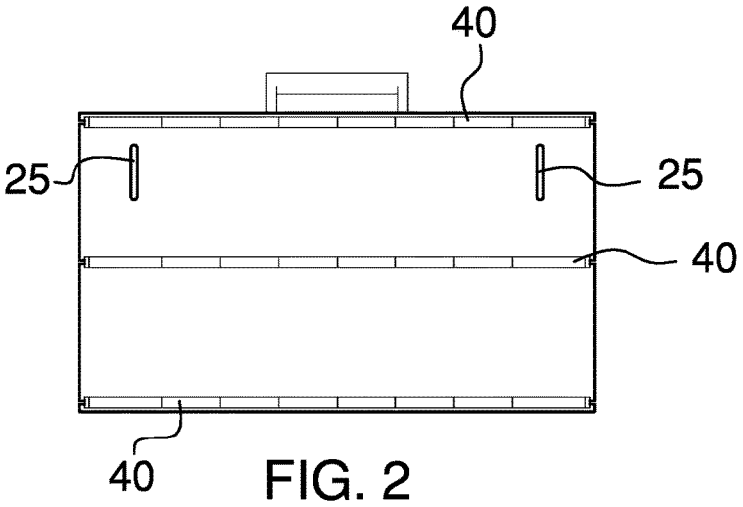
FIG. 2 is a bottom view of the device.
Figure 3:
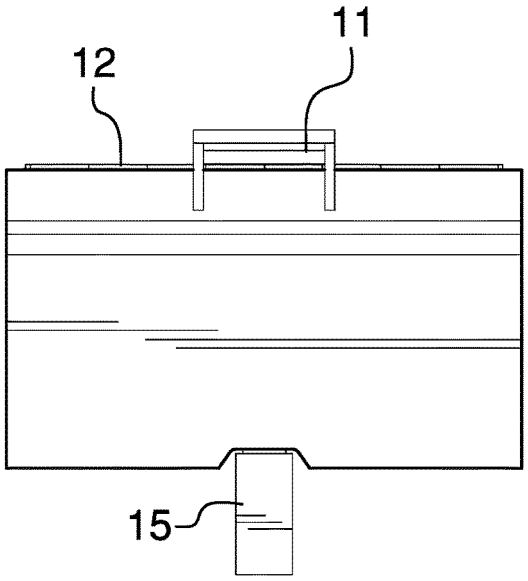
FIG. 3 is a top view of the device.

The bottom enclosure 8 has a first side, a second side, a top end, a bottom side, a front side, and a back side. The first side, second side, and bottom side, each provide two panels respectively, which is shown in FIG. 2, FIG. 3, and FIG. 4. The two panels on each respective side are connected to each other with a hinge 40. One of the two panels of the first side, second side, and bottom side is attached to the back side of the bottom enclosure 8 with a hinge 40. The other panel of each the first side, second side, and bottom side is attached to the front side of the bottom enclosure 8 with a hinge 40.

A locking brace 45 is provided between the two panels of the first and second sides of the bottom enclosure 8. FIG. 4 shows the locking brace 45 in dotted lines on a side of the bottom enclosure 8.

Figure 1:
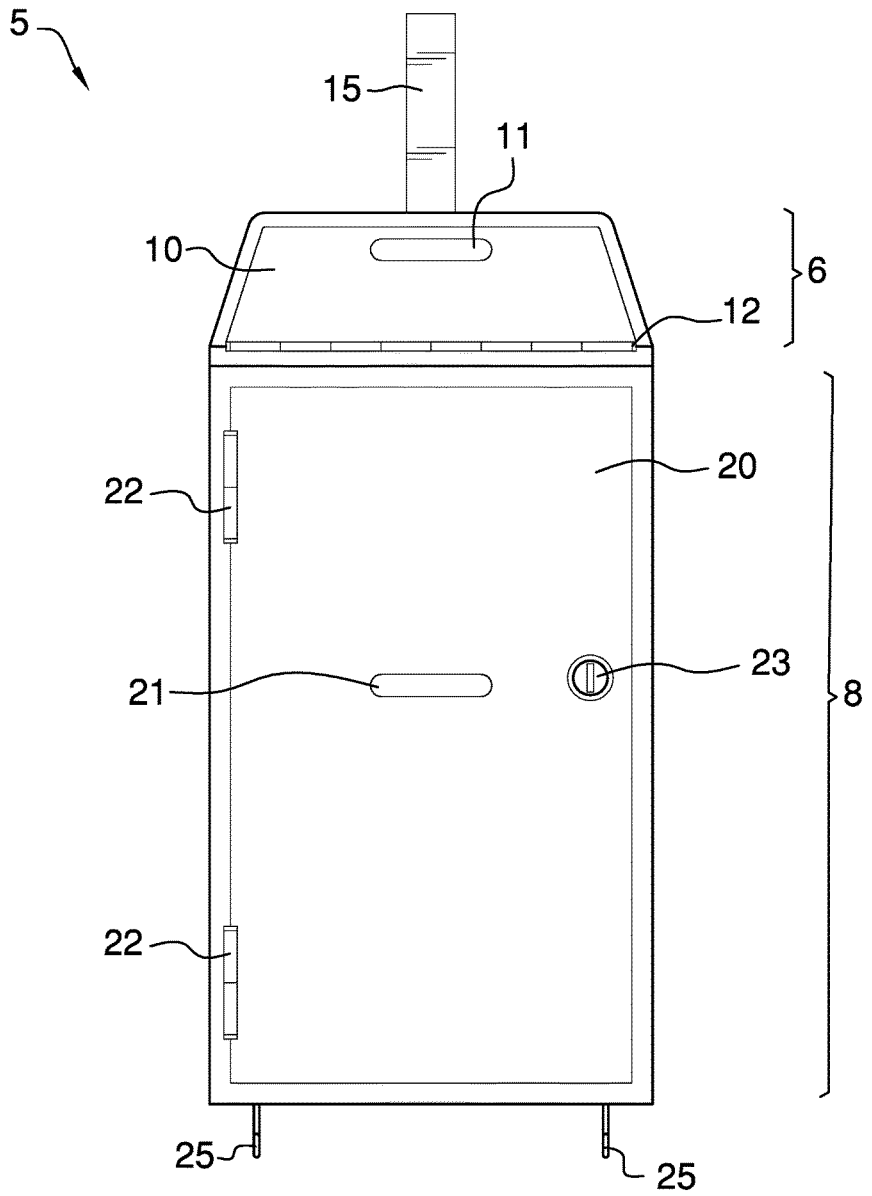
FIG. 1 is front view of the device, which is showing the top enclosure and the bottom enclosure.

The pick-up door 20 has a pick-up door handle 21, a lock 23, and a pick-up door hinge 22, which is shown in FIG. 1. The pick-up door hinge 22 is provided on the front side of the bottom enclosure 8 and allows the pick-up door 20 to rotate between an open and closed position. The pick-up door handle 21 allows a user to open and close the pick-up door 20 as well as collapse and expand the bottom enclosure 8.

The bottom enclosure 8 additionally provides a plurality of pins 24. The pins 24 fit within a set of parallel tracks 35 and slide along the track 35 when the bottom enclosure 8 is pulled or pushed between collapsed and expanded positions. When the bottom enclosure 8 is fully expanded, the interior locking braces 45 will lock the bottom enclosure 8 in the expanded position. The user must open the pick-up door 20 and unlock each locking brace 45 from inside the bottom enclosure 8 to then bring the bottom enclosure to a collapsed position. While it is not shown in the drawings, it is anticipated that a ratcheting mechanism, push pin, or the like could be utilized to lock the locking braces 45.

When an individual delivers the package she or he pulls on the drop off door handle 11, thereby forcing the door 10 to rotate about the drop off door hinge 12. The individual can then place a package into the door 10 and close the door 10, thereby allowing the package to then drop into the interior bag 30.

If the bottom enclosure 8 was initially in a closed position, the delivered package could force the bottom enclosure 8 to expand to an expanded position as the package falls into the interior bag 30. Alternatively, the delivery person could pull the pick-up handle 21 to then expand the bottom enclosure 8 prior to placing a package into the drop- off door 10.

Once a package is delivered it is secured until the recipient removes the apparatus from the secured delivery apparatus. The recipient must first unlock the lock 23, open the pick-up door 20, open the interior bag 30, and remove the package accordingly. It is anticipated that the lock 23 could be a lock and key, a combination lock, Bluetooth activated lock, or a biometric fingerprint reader, or the like. It is further anticipated that the interior bag 30 could have an additional locking mechanism.

Some additional features of the device are the use of a vibration detection sensor 55, an alarm, a controller 70 and an emergency mobile notification transmitter 65. In turn, the owner of the device would be notified if an individual attempted to steal, break, or otherwise tamper with the device. It is also anticipated that a mobile camera 60 could be provided on the device. The camera 60 would allow for capturing photos or a video of a package being delivered or a mischievous individual tampering with the device. If the vibration detector is triggered, the controller 70 could implement the camera 60 and alarm as well as send an emergency notification with the transmitter 65 to the user's mobile communication device via Wi-Fi. The camera 60 may be placed in the hangar to provide an elevated view of the surroundings of the parcel security apparatus. However, it is anticipated that the camera 60 could be placed on other parts of the invention.

While the embodiments of the invention have been disclosed, certain modifications may be made by those skilled in the art to modify the invention without departing from the spirit of the invention.

The invention claimed is:

1. A parcel security apparatus, which is comprised of:
- a. a top enclosure;
  - wherein the top enclosure has a drop-off door;
  - wherein the top enclosure has a drop-off door handle;
  - wherein the top enclosure has a track;
- b. a bottom enclosure;
  - wherein the bottom enclosure has a pick-up door;
  - wherein the pick-up door is attached to the bottom enclosure with at least one pick-up door hinge;
  - wherein the bottom enclosure has a plurality of panels;
  - wherein the bottom enclosure has a plurality of panel hinges for hingedly connecting adjacent panels of the plurality of panels;
  - wherein the bottom enclosure has a lock for the pick-up door;
  - wherein the bottom enclosure has a plurality of pins;
  - wherein the plurality of pins fit within the track;
  - wherein the bottom enclosure has at least one locking brace provided between at least two adjacent panels of the plurality of panels;
  - wherein the bottom enclosure has a plurality of hooks;
  - wherein the plurality of hooks is attached to the bottom side of the bottom enclosure;
- c. an interior bag;
  - wherein the interior bag is attached to the top enclosure above the track;
  - wherein the interior bag hangs within the bottom enclosure;
- d. a hanger;
  - wherein the hanger is attached to the top enclosure.

2. The parcel security apparatus described in claim 1 wherein the plurality of pins slide along the track.

3. The parcel security apparatus described in claim 1 wherein a handle is provided on the pick-up door.

4. The parcel security apparatus described in claim 1 wherein the plurality of hinges and plurality of panels enable the bottom enclosure to collapse and expand.

5. The parcel security apparatus described in claim 1 wherein the interior bag is knife resistant.

6. The parcel security apparatus described in claim 1 wherein the interior bag has a zipper.

7. The parcel security apparatus described in claim 1 wherein the hooks can hold an exterior bag.

8. The parcel security apparatus described in claim 7 wherein the exterior bag can accommodate oversized packages.

9. A parcel security apparatus, which is comprised of:
- a. a top enclosure;
  - wherein the top enclosure has a drop-off door;
  - wherein the top enclosure has a drop-off door handle;
  - wherein the top enclosure has a track;
- b. a bottom enclosure;
  - wherein the bottom enclosure has a pick-up door;

wherein the pick-up door is attached to the bottom enclosure with at least one pick-up door hinge;

wherein the bottom enclosure has a plurality of panels;

wherein the bottom enclosure has a plurality of panel hinges for hingedly connecting adjacent panels of the plurality of panels;

wherein the bottom enclosure has a lock for the pick-up door;

wherein the bottom enclosure has a plurality of pins;

wherein the plurality of pins fit within the track;

wherein the bottom enclosure has at least one locking brace provided between at least two adjacent panels of the plurality of panels;

wherein the bottom enclosure has a plurality of hooks;

wherein the plurality of hooks is attached to the bottom side of the bottom enclosure;

c. an interior bag;

wherein the interior bag is attached to the top enclosure above the track;

wherein the interior bag hangs within the bottom enclosure;

d. a hanger;

wherein the hanger is attached to the top enclosure.

e. a sensor;

wherein the sensor is a vibration sensor;

wherein the sensitivity of the sensor is programable;

wherein the sensor is attached to the interior of the bottom enclosure;

f. a camera;

wherein the camera is capable of taking pictures;

wherein the camera is capable of taking video;

wherein the camera is attached to the hanger;

g. a transmitter;

wherein the transmitter transmits pictures to a remote device;

wherein the transmitter transmits video to a remote device;

wherein the transmitter transmits preprogrammed messages to a remote device;

wherein the transmitter is attached to the interior of the bottom enclosure;

h. a controller;

wherein the controller is programable;

wherein preset features can be programmed into the controller;

wherein the controller is attached to the interior of the bottom enclosure.

10. The parcel security apparatus described in claim 9 wherein the pins slide along the track.

11. The parcel security apparatus described in claim 9 wherein a handle is provided on the pick-up door.

12. The parcel security apparatus described in claim 9 wherein the plurality of hinges and plurality of panels enable the bottom enclosure to collapse and expand.

13. The parcel security apparatus described in claim 9 wherein the interior bag is knife resistant.

14. The parcel security apparatus described in claim 9 wherein the interior bag has a zipper.

15. The parcel security apparatus described in claim 9 wherein the hooks can hold an exterior bag.

16. The parcel security apparatus described in claim 15 wherein the exterior bag can accommodate oversized packages.

* * * * *